United States Patent [19]

Wilson

[11] 4,025,185

[45] May 24, 1977

[54] APPLICATOR MEMBER

[75] Inventor: Lional Agustin Wilson, Redbourn, England

[73] Assignee: Xerox Corporation, Stamford, Conn.

[22] Filed: Apr. 14, 1975

[21] Appl. No.: 567,572

[30] Foreign Application Priority Data

May 24, 1974 United Kingdom ..... 23708/74

[52] U.S. Cl. ..... 355/10; 118/DIG. 15; 118/DIG. 23; 427/15

[51] Int. Cl.[2] ..... G03G 15/10

[58] Field of Search ..... 355/10; 118/DIG. 23, 118/DIG. 15, 639; 427/15; 29/123, 125

[56] References Cited

UNITED STATES PATENTS 2,280,208 4/1942 Wilkie ..... 29/123 X

*Primary Examiner*—R. L. Moses

[57] ABSTRACT

A novel liquid development system is disclosed wherein a rigid member adapted to move in contacting cooperation with a resilient surface is provided on at least one end with a semi-rigid end extender so that the surface of the end extender lies substantially in the same plane as the rigid surface. This extender is found to eliminate damage done to the resilient surface by reason of its contact with the edge of the rigid surface.

18 Claims, 18 Drawing Figures

APPLICATOR MEMBER

BACKGROUND OF THE INVENTION

The invention is related to the field of electrostatography and more specifically to liquid developing systems employed therein.

The formation and development of images on the surface of photoconductor material by electrostatic means is well known. The basic xerographic process as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light and developing the resulting electrostatic charge pattern image by depositing on the image a finely divided marking material referred to in the art as "toner". The toner will normally be attracted to those areas of the layer which retain a charge thereby forming a toner image corresponding to the electrostatic charge pattern. The powder image may then be transferred to a support surface such as paper and permanently affixed to the photoconductive layer if elimination of the powder transfer step is desired. In addition instead of forming a charge pattern by uniformly charging a photoconductor followed by image-wise light exposure, a charge pattern may be formed by directly charging the layer in image configuration. Other methods are known for applying marking particles to the imaging surface. Included within this group are the "cascade" development technique disclosed by E. N. Wise in U.S. Pat. No. 2,618,552; the powder cloud development technique disclosed by C. F. Carlson in U.S. Pat. No. 2,221,776; and the magnetic brush process disclosed, for example, in U.S. Pat. No. 2,874,063.

An additional dry development system involves developing a charge pattern with a powdered developer material, the powder having been uniformly applied to the surface of a powder applicator. The charge pattern is brought close enough to the developer powder applicator so that the developer powder is pulled from the powder applicator to the charge bearing image in image configuration. The charge pattern and powder applicator may desirably be brought in contact including contact under pressure to effect development. The powder applicator may be either smooth surfaced or roughened so that the developer powder is carried in the depressed portions of the patterned surface. Exemplary of this system are the techniques disclosed by H. G. Greig in U.S. Pat. No. 2,811,465.

Development of a charge pattern image may also be achieved with liquid rather than dry developer materials. In conventional liquid development more commonly referred to as electrophoretic development an insulating liquid vehicle having finely divided solid material dispersed therein contacts the imaging surface in both charged and uncharged areas. Under the influence of the electric field associated with a charged image pattern, the suspended particles migrate towards the charged portions of the imaging surface separating out of the insulating liquid. This electrophoretic migration of charged particles results in the deposition of the charged particles on the imaging surface in image configuration. Electrophoretic development of a charge pattern may, for example, be obtained by pouring the developer over the image surface, by immersing the imaging surface in a pool of the developer, or by presenting the liquid developer on a roller and moving the roller against the imaging surface. The liquid development technique has been shown to provide developed images of excellent quality and to provide particular advantages over other development methods in offering a development method which lends itself to use in compact reproduction machines.

An additional liquid technique for developing electrostatic charge patterns is the liquid development process disclosed by R. W. Gundlach in U.S. Pat. No. 3,084,043. In this method, a charge pattern is developed or made visible by presenting to the imaging surface a liquid developer on the surface of a developer dispensing member having a plurality of raised portions defining a substantially regular patterned surface and a plurality of portions depressed below the raised portions. The depressed portions contain a liquid developer which is maintained out of contact with the electrostatographic imaging surface. When the raised areas of the developer applicator are brought into contact with the imaging surface bearing a charge pattern, the developer creeps up the sides of raised portions in contact only with the charged area of the imaging surface, and is deposited thereon.

This technique is to be distinguished from conventional liquid development wherein there is an electrophoretic movement of charged particles suspended in a liquid carrier vehicle to the charged portion of the image bearing surface while the liquid substantially remains on the applicator surface and serves only as a carrier medium. In the liquid development method described by R. W. Gundlach in U.S. Pat. No. 3,084,043 the liquid phase actively takes part in the development of the image since the entire liquid developer is attracted to the charged portions of the image bearing surface. Furthermore, in the liquid development method described by R. W. Gundlach, unlike conventional liquid development, the developer liquid contacts only the charged portions of the image bearing surface.

A further liquid development technique is that referred to as "wetting development" or selective wetting described in U.S. Pat. No. 3,285,741. In this technique an aqueous developer uniformly and continuously contacts the entire imaging surface and, due to the selected wetting and electrical properties of the developer, substantially only the charged areas of the normally hydrophobic imaging surface are wetted by the developer. The developer should be relatively conductive having a resistivity generally from about $10^5$ to $10^{10}$ ohm cm and have wetting properties such that the wetting angle measured when the developer is placed on the imaging surface is smaller than 90° in the charged areas and greater than 90° in the uncharged areas.

In a compact electrostatographic copying device employing the development techniques disclosed by R. W. Gundlach in U.S. Pat. No. 3,084,043 or in U.S. Pat. No. 2,811,465 by H. G. Grieg the imaging surface and the liquid developer applicator are desirably small diameter cylinders or the like, to facilitate the cooperative movement of the surfaces in contact during development in a confined space. Such moving contact between the imaging surface and the applicator resulting in the transfer of liquid developer from the applicator to the photoreceptor occurs at development speeds ranging generally from about two to about 80 inches per second.

It has been proposed that one of the cooperating surfaces (either the photoreceptor or the applicator) be deformable, having a hardness of from about 30° to about 90° (shore A durometer) while retaining the functional integrity of its operative surface. The use of a deformable surface when at least one of such surfaces is arcuate, provides substantially uniform contact and a substantially uniform nip width between the surfaces.

Although capable of making satisfactory copies, it has been found that in such an arrangement of rigid and deformable surfaces, especially whenever the resilient surface is an imaging surface and the rigid surface is a developer applicator of a narrower width, the edges of the rigid surface are capable of damaging the resilient surface by for example cracking, chipping and scratching. This damage is especially noticeable wherever the pattern of recesses in a rigid applicator coincides with the edge of the applicator to form a file-like profile. Such damage may occur soon after the rigid and resilient surfaces come into contact, and the damage may increase in severity as the surfaces continue to move in contact. Long term moving contact, particularly at high speeds, may result in spreading of the damage across the face of the resilient surface. Such damage may cause unsatisfactory copies to be developed. The areas of a resilient imaging surface which are damaged by chipping, cracking or scraping will fail to support a charge pattern which can be developed. Such damaged areas may also collect unwanted developer which distracts from the image sought to be developed.

It is, therefore, an object of this invention to provide a liquid developing system devoid of the above noted deficiencies.

Another object of this invention is to provide a novel liquid development system.

It is an object of the invention to provide a novel apparatus for reducing the damage done to a resilient roller by a rigid roller.

These and other objects are accomplished according to the invention by providing a rigid member which comprises a rigid surface adapted to move in contacting cooperation with a resilient surface, at least one of said surfaces being arcuate, said rigid surface having at least one end a semi-rigid end extender fitted in such a way that the surface of the end extender lies substantially in the same plane as the rigid surface.

An embodiment of the invention will now be described by way of example with reference to the accompanying drawings in which.

Figure 1:
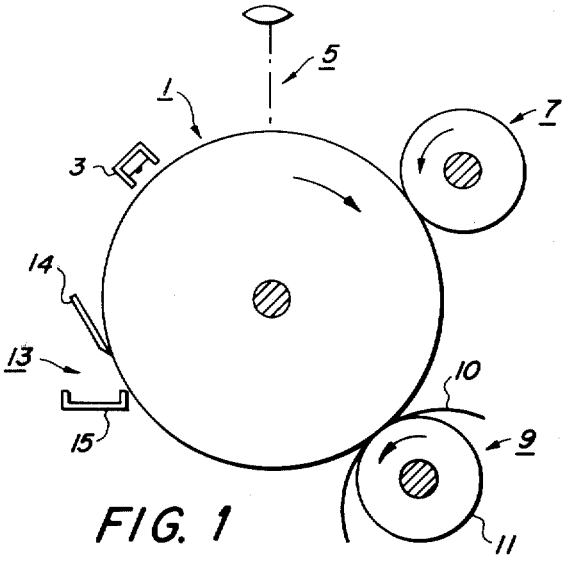
FIG. 1 is a schematic representation of a simplified xerographic system in which the development system of the instant invention may be employed showing the various major process steps and their relationship to one another.

Referring now to FIG. 1 there is shown a xerographic member generally designated 1 which in this exemplary instance may be photoconductive selenium coated on a resilient substrate. In operation, the xerographic member 1 is charged and exposed in the usual manner. Charged member 1 is then exposed to a light image at the exposure station generally designated 5 in order to form a charge pattern. Both charging and exposing are disclosed by C. F. Carlson in U.S. Pat. No. 2,297,691. The electrostatic image thus formed is then made visible at a developing station generally designated 7 where, in this example, liquid developer is applied to the photoconductive surface. Developing station 7 is, in this example, a rigid roller having a pattern of recesses on its surface and rigid end extenders on either end in accordance with the present invention and as more fully described in connection with FIGS. 2, 3, and 4. Although the developer applicator of this illustration is used for the development method taught by R. W. Gundlach in U.S. Pat. No. 3,084,043 it could also be used in the development systems described in U.S. Pat. Nos. 3,285,741 or 2,811,465 or for electrophoretic development. Also, by proper selection of the developer materials and the operating conditions, the developer can be made to deposit on background or non-charged areas in a process called "reversal imaging" as described in detail in, for example, U.S. Pat. No. 2,818,598. Whatever development technique is used, the image, now visible, is transferred to a receiver member at a transfer station generally designated 9. At transfer station 9, receiver member 10 which may be, for example, paper entrained over roller 11 is pressed into contact with the image on member 1. The image is thus transferred to the receiver member forming the final copy. The transfer of the image to the receiver member may be assisted by applying an electrical field of the proper polarity between roller 11 and xerographic member 1. Any developer material remaining on the xerographic member 1 after the transfer station 9 is removed at the cleaning station which is generally designated 13. The remaining developer material may be removed from the surface of the xerographic member 1 by a doctor blade 14, as shown in FIG. 1. The developer material which is doctored from the xerographic member is collected in tray 15.

The apparatus of FIG. 1 depicts a typical apparatus and typical configurations of imaging surface and applicator. It is to be understood that other configurations are possible, for example, one surface could be a flat plate while the other surface is arcuate at the point of contact between the surfaces. In another example, one of the surfaces could be a belt.

Figure 2:
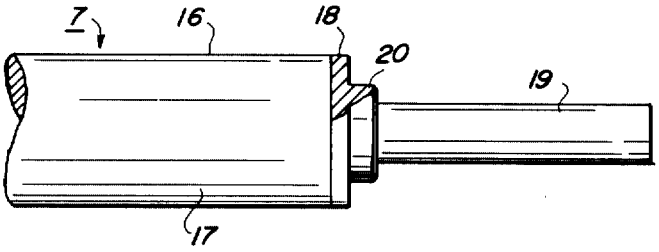
FIG. 2 shows in cross-section a typical example of a developer applicator roller in accordance with this invention.

Referring now to FIG. 2, there is shown schematically in cross-section a portion of a developer applicator roller 7. The liquid developer applicator roller 7 comprises a rigid member 17 which has a pattern of recesses on its surface 17. End extender 18 is fitted on roll shaft 19 so that it rests against the edge of the rigid member 16. If the end of the rigid roll 16 is shaped, for example, to be concave or convex, the end extender may have complementary shape to fit against the end of the rigid roll 16. The diameter of the end extender 18 is substantially the same as the diameter of the patterned rigid roll 16 measured at its raised portions. Although some variation is allowed between the surface of the end extender and the surface of the rigid member, preferably they are substantially in the same plane. If the surface of the end extender is raised too far above the surface of the rigid member, the rigid member will be held out of functional contact with the resilient member. On the other hand, if the surface of the end extender is too far below the surface of the rigid member the edge of the rigid member 16 will not be prevented from having a delitirious effect on the imaging surface. The surfaces of the rigid member 16 and the end extenders should be held between these two extremes.

Any suitable material may be used for the rigid roll 16. Typical materials are aluminum, steel, cast iron and brass. Steel is a preferred material because it is accurately machineable and it is relatively inflexible after machining. Machining is sometimes used to create the functional surface 17 on the rigid roll 16.

Functional surface 17 may have any suitable design. Typical functional surface designs include roughened areas, gravure-like recesses and grooves.

The end extender may be of any suitable semi-rigid material. Typical such materials are those having a Rockwell hardness at 23° C of from about R-100 to about R-140. Semi-rigid materials having a hardness of less than about R-100 do not provide sufficient stiffness to keep the edges of the rigid surface from damaging the resilient surface. Semi-rigid materials having a hardness of more than about R-140 may themselves cause damage to the resilient surface. Good results are obtained using a polyamide such as nylon, although polyurethanes and rubbers for example, may be used.

Any suitable width of end extender may be used depending on the particular application. Good results have been obtained with a width of 3/32 inch used on a rigid surface which is a developer applicator roll having a diameter of about one inch. A preferred embodiment of the present invention includes an end extender for such a rigid surface which has a width adjacent to the rigid surface of about 3/32 inch and a support section 20 having a width of about 5/32 inch. The support section 20 has a diameter of less than the narrower portion of the end extender. In the exemplary embodiment of FIG. 2, the liquid developer applicator roller may be made by first machining a desired pattern in the roller surface. The end extender 18 may then be pressed onto the roller shaft 19 so that it is flush against the edge of the rigid roll 16. Alternatively the end extender 18 may be machined to the proper shape after it has been placed on a rigid shaft 19.

The end extender itself may be moulded or machined to the proper shape from a suitable semi-rigid material.

Figure 3:
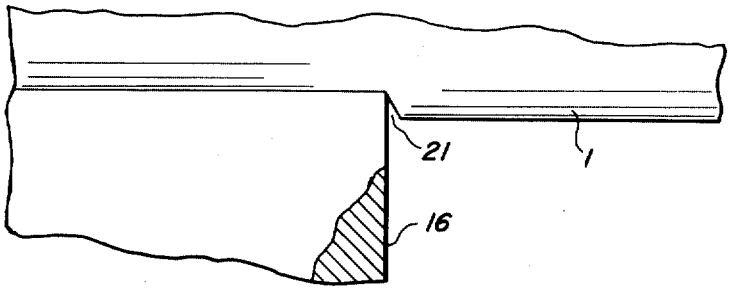
FIG. 3 shows in cross-section an enlarged portion of a rigid member and a resilient surface in contact.

Referring now to FIG. 3 there is shown in greatly enlarged cross-section the point of contact between a rigid surface 16 and a resilient surface 1. Normally, when the resilient surface is an imaging surface and the rigid surface is a developer applicator, the surfaces are in moving contact under a loading which ranges from about ¼ to about 3 pounds per linear inch. In the embodiment of FIG. 3 an end extender is not present, and the bending force of the edge of rigid surface against the resilient surface 7 is great as can be seen at edge contact point 21. Such a bending force is sufficient to cause damage such as cracking, chipping and scraping to the resilient surface.

Figure 4:
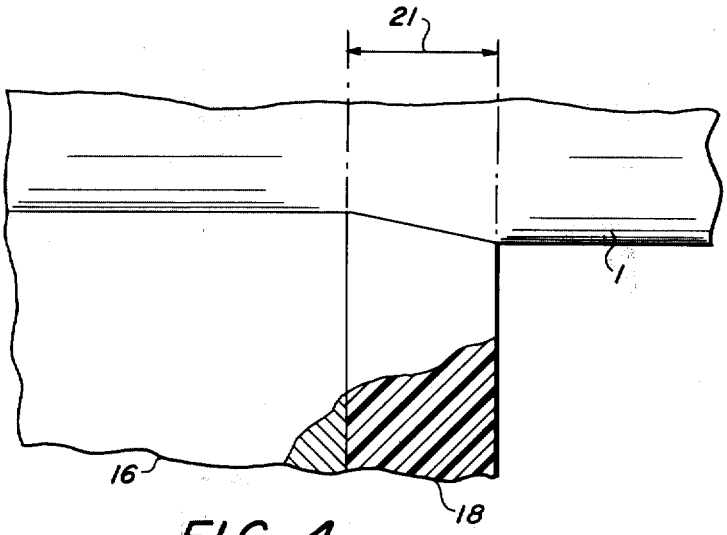
FIG. 4 shows in cross-section an enlarged portion of a rigid member with an end extender and a resilient surface in contact.

Referring now to FIG. 4 there is shown in greatly enlarged cross-section the point of contact between a rigid surface 16 and a resilient surface 1. In the embodiment of FIG 4 an end extender 18 as more fully described in connection with FIG. 2, is present. As can be seen in FIG. 4, the end extender spreads the bending force at edge contact point 21 over a relatively wide area. Such a spreading of the bending force is sufficient to prevent the deleterious effects which the edge of the rigid surface 16 will have on the resilient surface 1 in the embodiment of FIG. 3.

While a particular embodiment of the invention has been described above, it will be appreciated that various modifications may be made by one skilled in the art and without departing from the scope of the invention as defined in the appended claims.

What is claimed is:

1. Apparatus which comprises a rigid surface and a resilient surface, said rigid surface adapted to move in contacting cooperation with said resilient surface for development of electrostatic images on said resilient surface, at least one of said surfaces being arcuate and at least one of the surfaces comprises a pattern of recessed and raised portions, a semi-rigid end extender located on at least one end of said rigid surface to reduce damage to said resilient surface by said rigid surface, said extender fitted in such a way that the surface of the end extender lies substantially in the same plane as the rigid surface.

2. The apparatus of claim 1, wherein the rigid surface is a developer applicator.

3. The apparatus of claim 1, wherein the rigid surface is arcuate.

4. The apparatus of claim 1, wherein the resilient surface is arcuate.

5. The apparatus of claim 2, wherein the rigid surface is made from a material selected from the group consisting of steel, aluminium, brass and cast iron.

6. The apparatus of claim 2, wherein the rigid surface comprises said pattern of recessed and raised portions.

7. The apparatus of claim 1, wherein the semi-rigid material has a Rockwell hardness of from about R-100 to about R-140 at 23° C.

8. The apparatus of claim 1, wherein the semi-rigid material is a polyamide.

9. An imaging apparatus which comprises a rigid developer applicator comprising a pattern of recessed and raised portions, a resilient image forming member adapted to move in contacting cooperation with said rigid applicator, at least one of said applicator and said member having an arcuate surface, a semi-rigid end extender located on at least one of said rigid applicator to reduce damage to said resilient member by said rigid applicator, said extender fitted in such a way that the surface of said end extender lies substantially in the same plane as said rigid applicator's surface; means for charging said image forming member, means for exposing said member to provide a latent electrostatic image, said developer applicator adapted for developing said image forming member to form a visible image on said member.

10. The apparatus as defined in claim 9 further comprising transfer means to transfer said image.

11. An improved method of imaging comprising formation of a charge pattern on a deformable imaging surface, bringing into developing contact with said imaging surface a rigid developer applicator having a surface of raised and depressed portions, said depressed portions containing a developer liquid, at least one of said imaging surface and said developer applicator being arcuate, and transferring said liquid to the charged pattern on said imaging surface the improvement comprising providing an applicator having at least at one end a semi-rigid end extender to reduce damage to said deformable surface by said rigid applicator, said end extender being in substantially the same plane as the rigid surface.

12. The method of claim 11 further comprising transferring the developed pattern.

13. The method of claim 11 wherein said applicator is arcuate.

14. The method of claim 11 wherein said imaging member is arcuate.

15. A rigid liquid developer applicator comprising a rigid arcuate member whose surface comprises a pattern of recessed and raised portions and a semi-rigid end extender located on at least one end of said rigid member in such a way that the surface of said end extender lies in substantially the same plane as the surface of said rigid member and functions to reduce damage to resilient surfaces contacted by said applicator.

16. The applicator of claim 15 wherein the surface of said rigid member is made from a material selected from the group consisting of steel, aluminum, brass and cast iron.

17. The applicator of claim 15 wherein said semi-rigid material has a Rockwell hardness of from about R-100 to about R-140 at 23° C.

18. The applicator of claim 15 wherein said semi-rigid material comprises polyamide.

* * * * *